United States Patent [19]

Hemmelgarn

[11] 4,206,701

[45] Jun. 10, 1980

[54] LOCK MECHANISM FOR PRESS SHUTHEIGHT ADJUSTMENT

[75] Inventor: Donald J. Hemmelgarn, Minster, Ohio

[73] Assignee: The Minster Machine Company, Minster, Ohio

[21] Appl. No.: 18,452

[22] Filed: Mar. 8, 1979

[51] Int. Cl.[2] ..... B30B 1/06

[52] U.S. Cl. ..... 100/257; 74/586; 100/99; 151/15

[58] Field of Search ..... 100/99, 257; 74/586; 85/50 A, 1 T, 32 T; 151/15, 64, 19 A; 72/455, 456

[56] References Cited

U.S. PATENT DOCUMENTS

| | | | |
|---|---|---|---|
| 1,146,978 | 7/1915 | Walsh | 74/586 |
| 1,749,398 | 3/1930 | Strout | 100/257 |
| 1,788,071 | 1/1931 | Strout | 100/257 X |
| 2,185,096 | 12/1939 | Treer | 74/586 X |
| 2,608,253 | 8/1952 | Battles | 100/257 |
| 2,706,525 | 4/1955 | Ruppert | 100/257 X |
| 2,984,175 | 5/1961 | Wahl | 100/257 |
| 3,133,494 | 5/1964 | Hecht | 100/257 |
| 3,858,432 | 1/1975 | Voorhees | 72/456 X |
| 4,010,669 | 3/1977 | Kloren | 85/50 T |
| 4,150,618 | 4/1979 | Spanke | 100/257 |

*Primary Examiner*—Billy J. Wilhite
*Attorney, Agent, or Firm*—Albert L. Jeffers

[57] ABSTRACT

A lock mechanism for shutheight adjustment in a press having a frame with a crown and bed, a slide mounted for reciprocation toward and away from the bed, and a drive mechanism comprising one or more crankshaft driven connection screws for reciprocating the slide. The shutheight for the press is adjusted by means of a pair of internally threaded nuts on the threaded end portion of each of the connection screws, the nuts being connected to and carrying the slide. The nuts are keyed together so that they rotate in unison and are rotated by means of a worm mechanism turned either manually or by means of a motor. As the nuts rotate on their respective connection screws, the slide will be raised or lowered relative to the ram and to the bed of the press thereby adjusting the shutheight opening between the slide and bed. The adjustment mechanism is locked by means of a wedge-shaped split ring disposed between the nuts. When the split ring is contracted by means of an operator actuated lock screw, the nuts will be urged in opposite directions so as to take up the running clearance of the double nut in its housing. Since the normal thread clearance for the lock screw will also be taken up, the entire adjustment mechanism will be locked against movement until the lock screw is released.

17 Claims, 5 Drawing Figures

LOCK MECHANISM FOR PRESS SHUTHEIGHT ADJUSTMENT

BACKGROUND OF THE INVENTION

The present invention relates to mechanical presses and in particular to a shutheight adjusting mechanism for such presses.

Mechanical presses, for example, stamping presses and drawing presses, comprise a frame having a crown and bed and a slide supported within the frame for reciprocal motion toward and away from the bed. The slide is driven by a crankshaft having a connecting arm connected to the slide. Such mechanical presses are widely used for blanking and drawing operations and vary substantially in size and available tonnage depending upon the intended use.

In prior art presses of this type, the slide is generally connected to the crankshaft by a connecting rod which is adjustable in length or which is connected to another member that is adjustable in its relation to the slide so that the shutheight opening between the slide and bed can be adjusted to accommodate the press for various die sets. Alternatively, the bed portion or bolster of the press can have its position adjusted relative to the slide so as to adjust the shutheight therebetween, as disclosed in U.S. Pat. No. 3,858,432. Regardless of the mode of shutheight adjustment, the slide is generally guided on the upright portions of the press frame extending between the crown and bed so that the parts of the die set remain in accurate registration as the slide reciprocates.

Many prior art mechanical presses comprise a plurality of connection screws for reciprocating the slide, and it is customary practice to provide a shutheight adjusting mechanism whereby the position of the slide relative to each of the connection screws is adjusted simultaneously by means of an interconnected worm gear arrangement, which is driven either manually or by means of an operator controlled motor.

SUMMARY OF THE INVENTION

The present invention provides a shutheight adjustment and locking assembly which provides for positive lock-up of the slide in a minimum of space and with a minimum number of parts. This is accomplished by pressing a wedge-shaped split ring into matched surfaces of a double nut arrangement, which is contained within a housing on the slide. The split ring is contracted by means of a lock screw, which presses it against the nuts so as to take up the running clearance of the nuts in their housing, thereby preventing their turning. The lock screw will also lock against movement because of the takeup in the normal thread clearance for the screw threads. When the split ring is released by loosening of the lock screw, the double nut is free to turn on the threaded end portion of the connection screw. Since the two halves of the double nut are keyed together, they will turn as one and will carry with them the slide mechanism as their position is adjusted axially on the connection screw.

Such an arrangement, in addition to requiring very little space and a minimum of parts, can be located on the slide in such a manner that it is easily accessible. Furthermore, the adjustment and lock-up mechanism of the present invention is much less prone to jamming than prior art mechanisms which utilize a lock nut tightened against the adjusting nut, nor is there the difficulty in making accurate adjustments as is the case with that type of mechanism.

The locking mechanism of the present invention takes up all axial clearances in the adjustment mechanism, both the screw and housing clearances in one operation.

Specifically, the present invention is intended for use in a press having a frame structure with a crown portion and a bed portion, a first support member connected to the frame bed portion and adapted for having one half of a die set mounted thereto, a second support member adapted for having the other half of the die set mounted thereto, and a driven mechanism connected between the frame structure crown portion and the second support member for causing the second support member to reciprocate in opposed relation to the first support member. The present invention is a shutheight adjustment mechanism comprising first and second keyed-together threaded adjustment members threadedly connected between either the drive mechanism or the frame structure bed portion and its respective support member for adjusting the space between the first and second support members when the adjustment members are turned. A wedge-shaped lock element positioned adjacent one of the adjustment members is pressed thereagainst by lock means so as to wedge the adjustment member into a locked relationship relative to said drive mechanism or frame structure bed portion.

DETAILED DESCRIPTION

Figure 1:
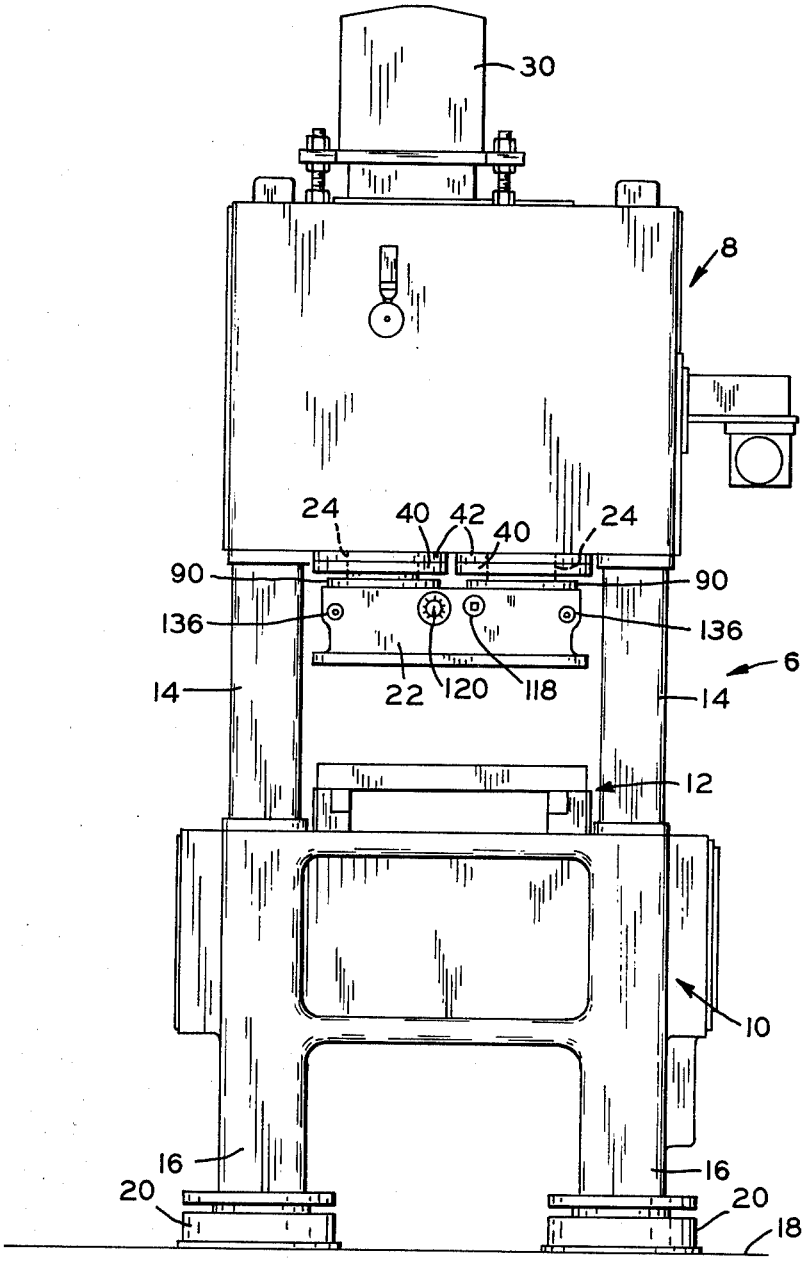
FIG. 1 is a front elevational view of a mechanical press incorporating the shutheight adjustment and lock mechanism of the present invention.

Referring now to the drawings, press 6 comprises a crown portion 8, a bed portion 10 having a bolster 12 connected thereto and uprights 14 connecting the crown portion 8 with the bed portion 10. Uprights 14 are connected to or integral with the underneath side of crown 8 and with the upper side of bed 10. Leg members 16 are formed as an extension of bed 10 and are generally mounted on the shop floor 18 by means of shock absorbing pads 20.

Figure 2:
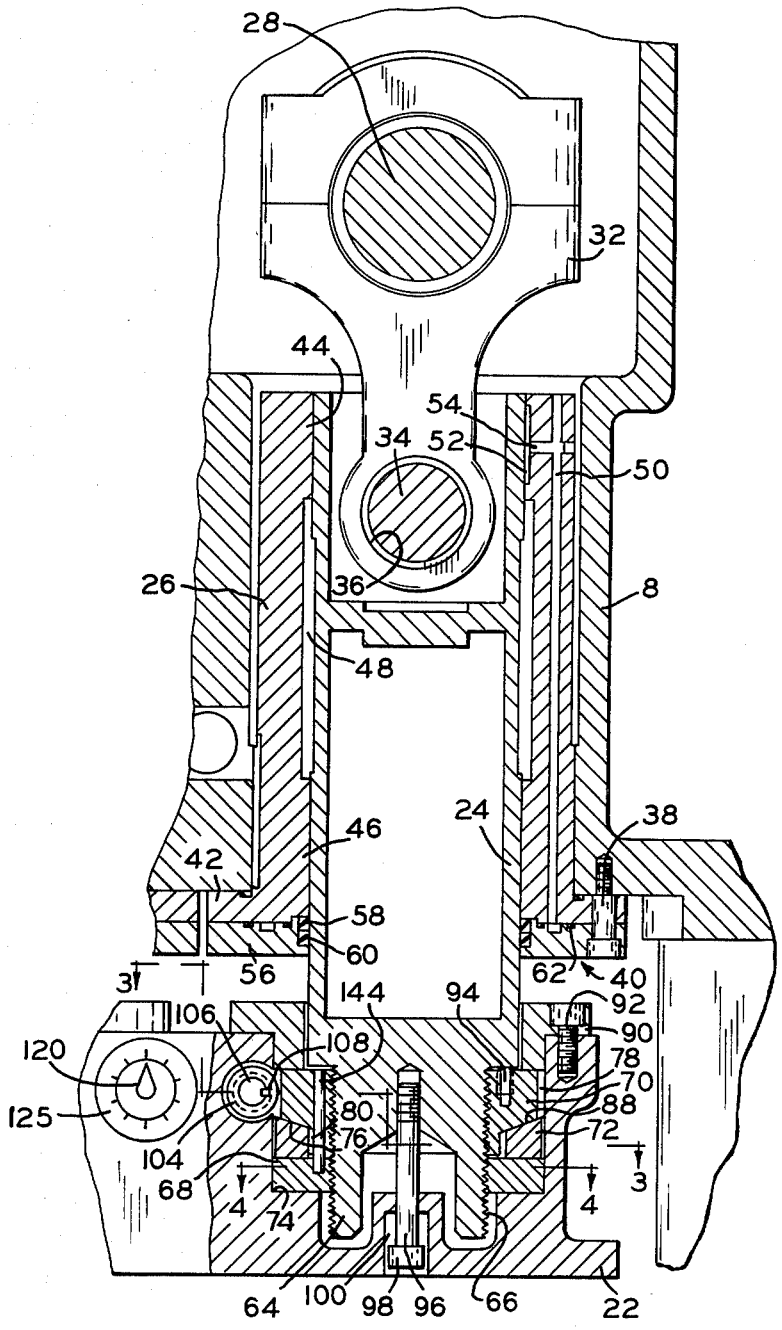
FIG. 2 is an enlarged, fragmentary sectional view of the shutheight adjusting and locking mechanism for one of the connection screws shown in FIG. 1.

Referring more particularly to FIG. 2, slide 22 is connected to a pair of connection screws 24, the latter being received in cylinders 26 for vertical reciprocating movement within crown portion 8. The drive mechanism, of which connection screws 24 and cylinders 26 are a portion, comprises a pair of crankshafts 28 driven through a conventional clutch arrangement (not shown) by motor 30. In order to simplify description, only one side of the drive mechanism will be described, although it should be understood that the present invention is not limited to presses with a specific number of connection screws for reciprocating the slide 22, nor to this particular type of drive arrangement.

Each of the connecting rods 32 has crankshaft 28 journaled therein and is connected to connection screw 24 by means of pin 34 journaled within a housing 36 at the lower end thereof. In a conventional manner as, for example, disclosed in the aforementioned U.S. Pat. No. 3,858,432, which is incorporated herein by reference, crank pin 34 is pivotally connected to connection screw 24. Connection screw 24 is guided within cylinder 26, which is secured within crown portion 8 by means of screws 38, which pass through seal assembly 40 and the flange portion 42 of cylinder 26. Cylinder 26 has an upper annular portion 44 and a lower annular region 46, each of which serves as a bearing surface to guide the connection screw 24 as it undergoes reciprocating motion along the axis of the cylinder 26. Between the aforementioned annular regions 44 and 46, cylinder 26 includes an annular space 48 which serves as a lubricant drainage area to collect oil escaping from the interfaces between connection screw 24 and annular regions 44 and 46. Lubricant passageway 50 provides a supply of oil to connection screw 24 and is connected to chamber 52 through passageway 54.

Seal assembly 40 comprises an annular plate 56 secured to crown 8 and cylinder 26 by means of screws 38, a pair of O-rings 58 and 60 compressed between plate 56 and connection screw 24, and an O-ring 62.

Figure 5:
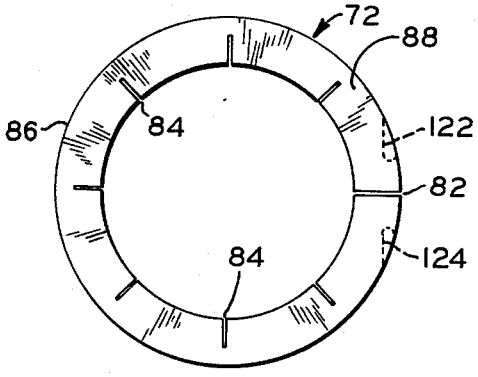
FIG. 5 is a plan view of the split lock ring forming a part of the present invention.

The lower end of connection screw 24 comprises a cylindrical portion 64 having threads 66 on the outer surface thereof. A lower adjustment nut 68 and an upper adjustment nut 70 threadedly engage portion 64 and have a coaxial split locking ring 72 positioned between them. Lower nut 68 has a generally cylindrical configuration and is received within the lower portion of a recess 74 in slide 22. Upper nut 70 has an inclined annular surface 76 extending from the outer periphery 78 thereof and terminating at a downwardly extending annular portion 80. Split ring 72, which is shown in FIG. 5, comprises a radial gap 82, and a plurality of radial slots 84 terminating short of the outer periphery 86 of ring 72 to impart flexibility. The upper surface 88 of ring 72 is axially inclined so as to mate with surface 76 of upper nut 70. The assembly of nuts 70 and 68 and split ring 72 are retained within the recess 74 in slide 22 by retainer 90, which is secured to slide 22 by screws 92. Set screw 94 provides an upper stop for the nut assembly, and screw 96, which is tightened into connection screw 24, provides the lower stop for slide 22. It will be noted that the head 98 of screw 96 is received within recess 100. Other types of stops are also possible.

Upper nut 70 is provided with teeth 102 which are in intermeshing engagement with worm 104, the latter being keyed to shaft 106 by key 108. Shaft 106 is rotatably supported within bearings 110 and 112, which are retained by snap rings 114 and 116, respectively. The proximal end 118 of shaft 106 is hexagonally shaped so that it can be turned by means of a standard socket wrench. It will be appreciated that as shaft 106 is rotated, worm 104 will drive upper nut 70 and will drive the upper nut 70*a* for the adjacent identical mechanism through gears 119 and 121 and worm shaft 123. Pointer 120, which is connected to worm shaft 123, indicates the number of revolutions of shaft 106 and, by properly graduating its dial 125, can indicate the change in shutheight opening for slide 22.

Figure 3:
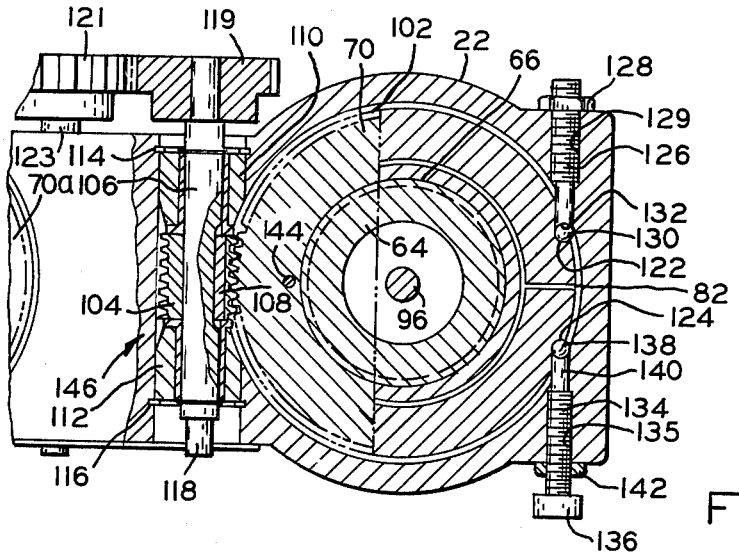
FIG. 3 is a sectional view taken along line 3—3 of FIG. 2 and viewed in the direction of the arrows.
Figure 4:
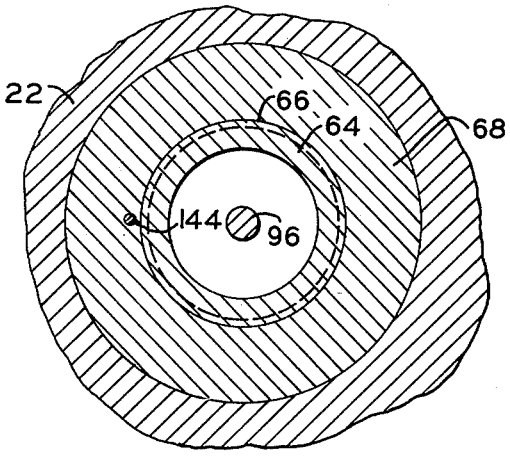
FIG. 4 is a fragmentary sectional view taken along line 4—4 of FIG. 2 and viewed in the direction of the arrows.

With particular reference now to FIGS. 3 and 5, it will be seen that split ring 72 is provided with a pair of recesses 122 and 124, which are oriented generally tangentially to the circumferential direction of ring 72. In order to constrict ring 72 so as to lock the adjustment mechanism, a threaded screw 126 having a lock nut 128 is threadedly received in a bore 129 in slide 22. A steel ball 130 is received within recess 122 and is captured by the arcuate end 132 of screw 126. Adjusting screw 134 is threaded in bore 135 and includes a knurled head 136 adapted to be easily gripped and turned. Another steel ball 138 is received within recess 124 and is engaged by the end of 140 of screw 134. It will be seen that as screw 134 is tightened, ring 72 will be compressed between balls 130 and 138 and will constrict so as to close gap 82. At this point, lock nut 142 is tightened on screw 134 so as to take up the thread clearance. Upper nut 70 is keyed to lower nut 68 by means of dowel 144, which passes through aligned openings in nuts 70 and 68 and passes behind split ring 72.

The adjusting and lock mechanism operates in the following manner. To unlock the mechanism, lock nuts 142 are loosened and screws 134 are turned counterclockwise thereby permitting split ring 72 to open. This will restore the running clearance between nuts 68, 70 and the housing formed by slide 22 and retainer 90 thereby allowing nuts 68 and 70 to rotate on the threaded end portion 64 of connection screw 24. A socket wrench is placed on the end 118 of worm assembly 146, and is turned either clockwise or counterclockwise to lower or raise, respectively, slide 22. This occurs by virtue of the fact that keyed-together nuts 68 and 70, which rotate in unison, will be raised or lowered on the threaded end portion 64 of connection screw 24, and will carry with them slide 22, which is connected to nuts 68 and 70 by retainer 90. Once the desired degree of shutheight between slide 22 and bolster 12 is achieved, the assembly is again locked by turning screws 134 clockwise thereby contracting rings 72. As each of the rings 72 contracts, inclined surface 88 tends to raise nut 70 by acting against inclined surface 76. This takes up the running clearance between nuts 68, 70 and slide 22 and retainer 90 thereby preventing rotation of nuts 68 and 70. Screws 134 are then prevented from loosening by tightening lock nuts 142.

It should be noted that, as an alternative to taking up the running clearance between nuts 68 and 70 and their housing in order to lock up the mechanism, it would also be possible to tighten nuts 68 and 70 on their threads. The preferred embodiment, however, is to take up the running clearance between the nuts and their housing. Although the embodiment of the invention described above is incorporated between the slide and connection screw, it would also be possible to use a very similar mechanism to raise and lower the bolster or bed of the press, as was done in the aforementioned U.S. Pat. No. 3,858,432.

The present invention is intended to cover all types of mechanical presses wherein "press" is construed in its broadest sense to include straight side presses, gap-type presses, press brakes, and other types of presses in addition to the press described above.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. In a press having a frame structure with a crown portion and a bed portion, a first support means connected to said frame bed portion and adapted for having one half of a die set mounted thereto, a second support means adapted for having the other half of a die set mounted thereto, and drive means connected between said frame structure crown portion and said second support means for causing said second support means to reciprocate in opposed relation to said first support means, said first and second support means being spaced apart, the improvement being a press shutheight adjustment mechanism comprising: first and second keyed together threaded adjustment means threadedly connected between one of said drive means of said frame structure bed portion and the respective said support means connected thereto for adjusting the spacing between said first and second support means when said adjustment means are turned, a wedge-shaped lock element positioned adjacant one of said adjustment means, and means for urging said lock element against said one threaded adjustment means to wedge said one adjustment means into a locked relationship relative to said one of said drive means or said frame structure bed portion.

2. The press of claim 1 wherein said drive means includes a connection screw element having threads thereon and said first and second adjustment means comprises respective first and second threaded nuts threadedly engaging said connection screw threads.

3. The press of claim 2 wherein said wedge-shaped lock element comprises a split lock ring having a wedge-shaped radial cross-section, said lock ring being positioned between said first and second nuts and being one of expanded or contracted in the radial direction by said means for urging.

4. The press of claim 3 wherein said lock ring includes at least one annular inclined cam surface acting against at least one annular inclined cam surface on one of said nuts.

5. The press of claim 2 wherein said nuts are keyed together by means of a dowel.

6. In a press having a frame with a crown portion and a bed portion, a slide mounted for reciprocation toward and away from said bed portion, and drive means for reciprocating said slide, a shutheight adjusting mechanism connecting said slide to said drive means comprising: first and second keyed-together threaded means threadedly connected to threads on one of said drive means or said slide and engaging the other of said drive means or slide so as to adjust the position of said slide relative to said bed when said threaded means are turned, a wedge-shaped lock element positioned between said first and second threaded means, and means for pressing said wedge-shaped lock element against said threaded means so as to urge said threaded means apart thereby causing them to lock against rotation and lock against axial movement.

7. The press of claim 6 wherein said drive means includes a connection screw having a cylindrical end portion including said threads, said threaded means comprise first end threaded nuts, respectively, threadedly engaging said threads, and said slide is carried by said nuts as said nuts are threaded along said cylindrical end portion.

8. The press of claim 7 wherein one of said nuts includes an annular first surface and an annular second surface axially inclined relative to said first surface, said lock element comprises a split ring having a wedge-shaped radial cross-section, and said means for pressing comprises means for contracting said ring in a radial direction.

9. The press of claim 8 wherein said means for contracting comprises a threaded screw assembly tangentially engaging said lock ring.

10. The press of claim 9 wherein said screw assembly includes a pair of opposing threaded screws engaging oppositely facing abutment surfaces on said lock ring.

11. The press of claim 8 wherein said one nut includes an annular portion radially within said lock ring.

12. The press of claim 8 wherein said lock ring includes a plurality of radial inwardly opening slots.

13. The press of claim 7 wherein one of said nuts includes gear teeth on its periphery, and including a worm engaging the teeth of said one nut and means for selectively rotating said worm so as to adjust the position of said nuts on said connection screw end portion.

14. The press of claim 7 wherein said lock element comprises a split ring having a wedge-shaped radial cross-section, and said nuts and lock ring are disposed within a recessed area in said slide and retained therein by means of a retainer concentric with said connection screw end portion and secured to said slide.

15. The press of claim 6 wherein said drive means includes a plurality of connection screws each having a threaded cylindrical end portion, said shutheight adjusting mechanism comprises a pair of threaded nuts threadedly secured to each of said end portions, and said slide is connected to and carried by said pairs of nuts.

16. The press of claim 15 wherein there are two said connection screws and one nut of each of said pair of nuts is toothed, and including a worm mechanism drivingly connected to said toothed nuts so as to rotate them in unison when the worm rotates.

17. The press of claim 6 wherein said first and second threaded means are contained within a housing and normally have running clearance in said housing when the adjusting mechanism is unlocked, and wherein said lock element is pressed against said threaded means, the running clearance of said threaded means is taken up and said threaded means are locked against said housing.

* * * * *